US010921036B2

(12) United States Patent
Tarr et al.

(10) Patent No.: US 10,921,036 B2
(45) Date of Patent: Feb. 16, 2021

(54) STAND-ALONE ICE MAKING APPLIANCE HAVING INSULATING OR SEALING FEATURES

(71) Applicant: Haier US Appliance Solutions, Inc., Wilmington, DE (US)

(72) Inventors: Ronald Scott Tarr, Louisville, KY (US); Samuel Vincent DuPlessis, Louisville, KY (US); Tomas Garces, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 84 days.

(21) Appl. No.: 15/951,271

(22) Filed: Apr. 12, 2018

(65) Prior Publication Data

US 2019/0316824 A1 Oct. 17, 2019

(51) Int. Cl.

| | |
|---|---|
| ***F25C 5/182*** | (2018.01) |
| ***F25C 1/04*** | (2018.01) |
| ***F25D 17/02*** | (2006.01) |

(52) U.S. Cl.

CPC ..... *F25C 5/182* (2013.01); *F25C 1/04* (2013.01); *F25D 17/02* (2013.01)

(58) Field of Classification Search

CPC ..... F25C 5/182; F25C 1/04; F25C 2500/06; F25D 17/02; F25D 2323/122

USPC ..... 62/344, 464

See application file for complete search history.

(56) References Cited

U.S. PATENT DOCUMENTS

| | | | | | |
|---|---|---|---|---|---|
| 2,542,892 | A * | 2/1951 | Bayston | F25C 1/045 | 62/347 |
| 2,569,113 | A * | 9/1951 | Munshower | F25C 1/04 | 62/233 |
| 2,672,016 | A * | 3/1954 | Muffly | F25C 1/08 | 62/137 |
| 2,672,017 | A * | 3/1954 | Muffly | F25C 1/06 | 62/137 |
| 2,682,155 | A * | 6/1954 | Ayres | F25C 1/12 | 62/138 |
| 2,722,110 | A * | 11/1955 | Denzer | F25C 1/045 | 62/73 |
| 2,774,224 | A * | 12/1956 | Bayston | F25C 1/045 | 62/138 |
| 2,787,890 | A * | 4/1957 | Muffly | F25C 1/06 | 62/137 |

(Continued)

OTHER PUBLICATIONS

Firstbuild, Opal Nugget Ice Maker, Indiegogo, Aug. 27, 2015, https://www.indiegogo.com/projects/opal-nugget-ice-maker#/.

*Primary Examiner* — Len Tran
*Assistant Examiner* — Kirstin U Oswald
(74) *Attorney, Agent, or Firm* — Dority & Manning, P.A.

(57) ABSTRACT

A stand-alone ice making appliance, as provided herein, may include an outer casing, a water tank, a pump, an ice maker, and a container. The outer casing may define an internal cavity that includes a primary opening. The water tank may define a storage volume to receive water. The pump may be in fluid communication with the storage volume of the water tank to actively flow water therefrom. The ice maker may in fluid communication with the storage volume of the water tank to receive water therefrom. The container may be disposed within the internal cavity. One or more insulated walls or sealing features may be further included herein.

20 Claims, 10 Drawing Sheets

(56) References Cited

U.S. PATENT DOCUMENTS 2,791,103 A * 5/1957 Guild ..... F25C 1/12 62/137
2,806,357 A * 9/1957 Pichler ..... F25C 1/12 62/138
2,834,189 A * 5/1958 Jaeger ..... F25C 1/12 62/73
2,860,027 A * 11/1958 Swanson ..... F25C 5/18 312/312
2,866,322 A * 12/1958 Muffly ..... F25C 1/12 62/137
2,877,632 A * 3/1959 Chaplik ..... F25C 1/147 62/320
2,887,852 A * 5/1959 Thomas ..... F25C 1/12 62/138
2,937,508 A * 5/1960 Garland ..... F25C 5/185 62/137
2,963,885 A * 12/1960 Loewenthal ..... F25C 1/12 62/344
2,997,860 A * 8/1961 Muffly ..... F25C 5/24 62/344
3,009,336 A * 11/1961 Bayston ..... F25C 1/045 62/344
3,021,686 A * 2/1962 Alt ..... F25C 5/187 62/132
3,144,755 A * 8/1964 Kattis ..... F25C 1/12 62/137
3,205,666 A * 9/1965 Gould ..... F25B 21/04 62/3.63
3,423,952 A * 1/1969 Pugh ..... F25C 1/12 62/138
4,055,053 A * 10/1977 Elfving ..... F25B 21/02 62/3.63
4,347,713 A * 9/1982 Morrison ..... B65D 81/383 62/371
4,519,219 A * 5/1985 Prepodnik ..... F25D 3/06 206/519
4,706,466 A * 11/1987 Yingst ..... F25C 1/12 312/201
4,722,199 A * 2/1988 Hibino ..... F25C 5/182 49/496.1
4,942,983 A * 7/1990 Bradbury ..... F25C 5/24 222/238
4,966,015 A * 10/1990 Wessa ..... F25C 1/045 62/347
5,056,334 A * 10/1991 Hooper ..... F25C 1/12 62/320
5,345,782 A * 9/1994 Takahashi ..... F25C 1/12 62/344
8,756,950 B2 6/2014 Brunner et al.
9,273,894 B1 * 3/2016 Whitty ..... F25C 1/00
2008/0083235 A1 * 4/2008 Wang ..... F25C 1/04 62/135
2014/0196493 A1 7/2014 Mitchell
2017/0248357 A1 8/2017 Gardner et al.
2018/0017305 A1 * 1/2018 Tarr ..... F25C 5/182

* cited by examiner

STAND-ALONE ICE MAKING APPLIANCE HAVING INSULATING OR SEALING FEATURES

FIELD OF THE INVENTION

The present subject matter relates generally to ice making appliances, and more particularly to ice making appliances that produce nugget ice.

BACKGROUND OF THE INVENTION

Ice makers generally produce ice for the use of consumers, such as in drinks being consumed, for cooling foods or drinks to be consumed and/or for other various purposes. Certain refrigerator appliances include ice makers for producing ice. The ice maker can be positioned within the appliance's freezer chamber and direct ice into an ice bucket where it can be stored within the freezer chamber. Such refrigerator appliances can also include a dispensing system for assisting a user with accessing ice produced by the refrigerator appliance's ice maker. However, the incorporation of ice makers into refrigerator appliances can have drawbacks, such as limits on the amount of ice that can be produced and the reliance on the refrigeration system of the refrigerator appliance to form the ice.

Recently, stand-alone ice makers have been developed. These ice makers are separate from refrigerator appliances and provide independent ice supplies. Generally, ice is provided into an interior volume. However, many stand-alone ice makers do not include an interior volume that is visible without opening the ice maker. Condensation and/or insulation may create difficulties in determining how much ice is contemporaneously available within the interior volume. Moreover, removing ice from the interior volume of many existing systems may be difficult. The area defining the interior volume may be provided as a removable bucket. Such systems may become increasingly heavy and/or difficult to remove if, for instance, a large amount of ice is held therein. If any ice within the interior volume has melted, it may be further difficult to remove the liquefied ice or water. Additionally or alternatively, difficulties may arise when trying to add water to the system for producing ice (e.g., without inadvertently spilling water outside the ice maker or within an undesired interior portion of the ice maker).

Accordingly, improved stand-alone ice makers are desired in the art. In particular, cost-effective stand-alone ice makers that address several of the above issues would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a stand-alone ice making appliance is provided. The stand-alone ice making appliance may include an outer casing, a water tank, a pump, an ice maker, and a container. The outer casing may define an internal cavity. The internal cavity may include a primary opening through which the internal cavity may be accessed. The water tank may define a storage volume to receive water. The pump may be in fluid communication with the storage volume of the water tank to actively flow water therefrom. The ice maker may be in fluid communication with the storage volume of the water tank to receive water therefrom. The container may be disposed within the internal cavity. The container may include a plurality of insulated sidewalls received within the internal cavity. The plurality of insulated sidewalls may at least partially define a storage volume to receive ice from the ice maker. The sidewall of the plurality of sidewalls may include an internal panel proximal to the storage volume and an external panel distal to the storage volume. The internal panel and the external panel may define an insulation gap therebetween.

In another exemplary aspect of the present disclosure, a stand-alone ice making appliance is provided. The stand-alone ice making appliance may include an outer casing, a water tank, a pump, an ice maker, a container, and a plug prong. The outer casing may define an internal cavity. The internal cavity may include a primary opening through which the internal cavity may be accessed. The water tank may define a storage volume to receive water. The pump may be in fluid communication with the storage volume of the water tank to actively flow water therefrom. The ice maker may be in fluid communication with the storage volume of the water tank to receive water therefrom. The container may be selectively positioned within the internal cavity. The container may include a plurality of walls defining a storage volume to receive ice from the ice maker, a drain aperture defined through one wall of the plurality of walls, and a biased sealing plug. The drain aperture may be in fluid communication between the storage volume of the container and the storage volume of the water tank. The biased sealing plug may be paired with drain aperture. The biased sealing plug may be urged toward the drain aperture to selectively restrict fluid communication therethrough. The plug prong may be fixed within the outer casing and selectively mated with the biased sealing plug to urge the biased sealing plug away from the drain aperture.

In yet another exemplary aspect of the present disclosure, a stand-alone ice making appliance is provided. The stand-alone ice making appliance may include an outer casing, a pump, a water tank, a plug prong, an ice maker, and a container. The outer casing may define an internal cavity. The internal cavity may include a first primary opening and a second primary opening through which the internal cavity may be accessed. The pump may be disposed within the outer casing to actively flow water therethrough. The water tank may be selectively positioned within the internal cavity through the second primary opening in fluid communication with the pump. The water tank may include a plurality of walls defining a storage volume to receive water upstream from the pump. The fluid outlet may be defined through one wall of the plurality of walls. The fluid aperture may be in fluid communication between the storage volume of the water tank and the pump. The biased sealing plug may be paired with fluid aperture. The biased sealing plug may be urged toward the fluid aperture to selectively restrict fluid communication therethrough. The plug prong may be fixed within the outer casing and selectively mated with the biased sealing plug to urge the biased sealing plug away from the fluid aperture. The ice maker may be in fluid communication with the storage volume of the water tank to receive water therefrom. The container may be selectively positioned within the internal cavity through the first primary opening. The container may define a storage volume to receive ice from the ice maker.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
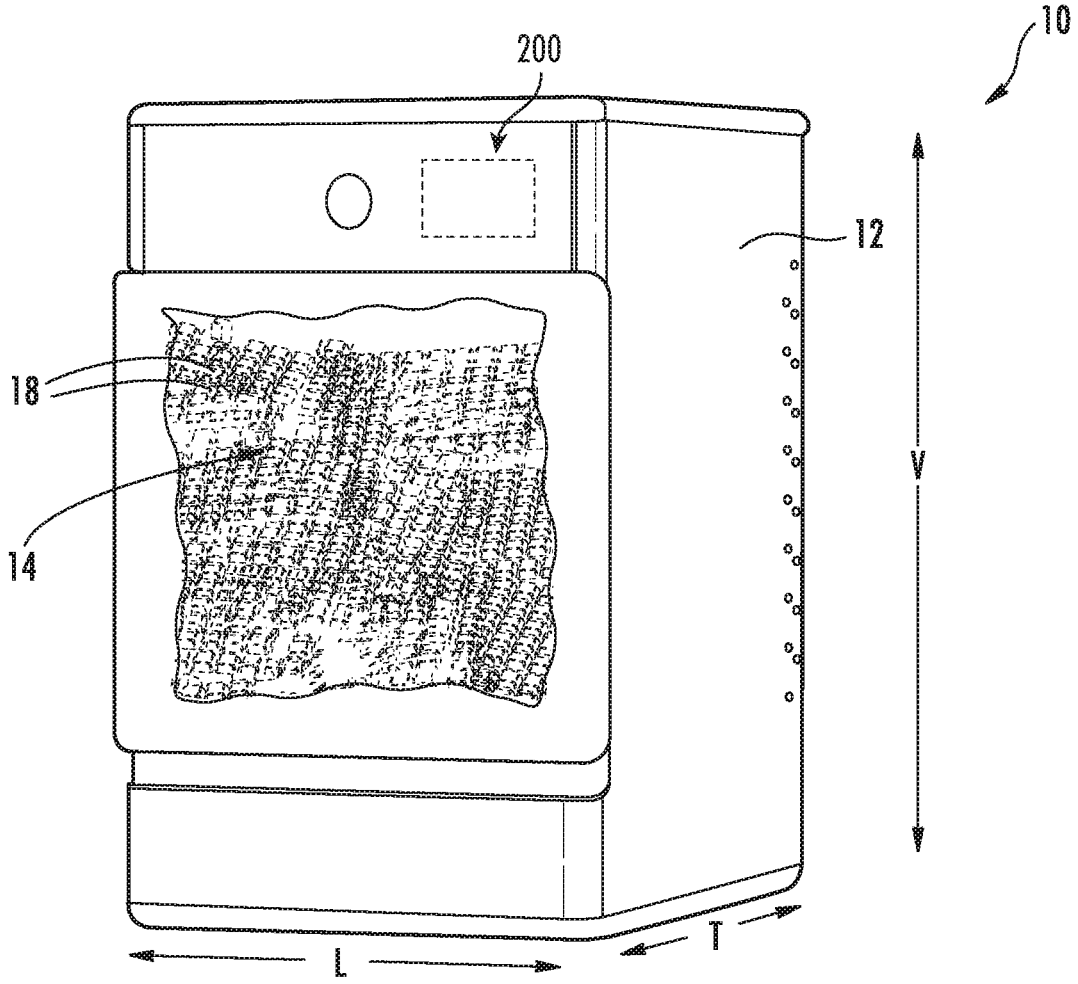
FIG. 1 provides a perspective view of an appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
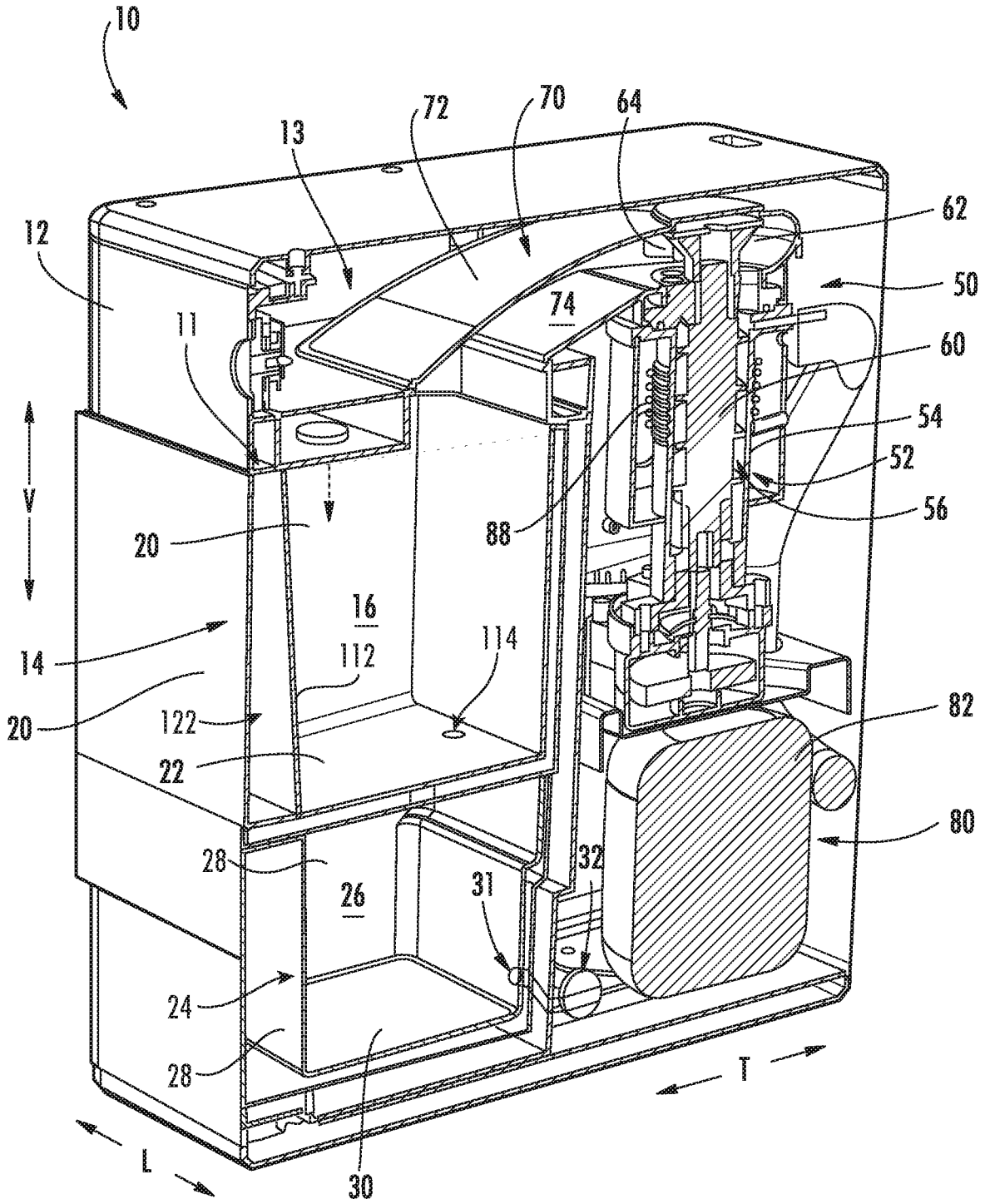
FIG. 2 provides a perspective sectional view of an appliance according to an exemplary embodiment of the present disclosure.
Figure 3:
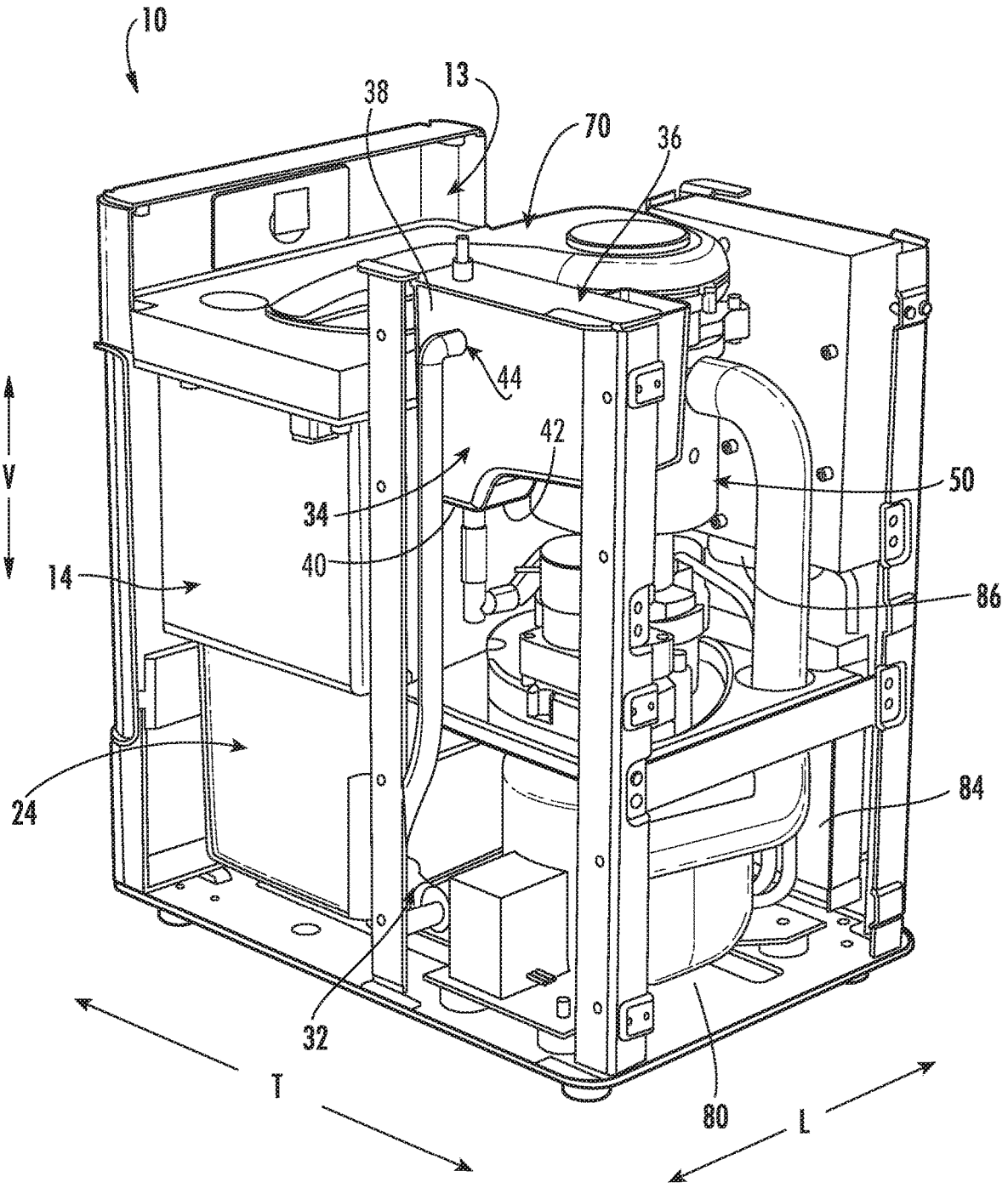
FIG. 3 provides a rear perspective view (with a casing removed) of an appliance according to an exemplary embodiment of the present disclosure.
Figure 4:
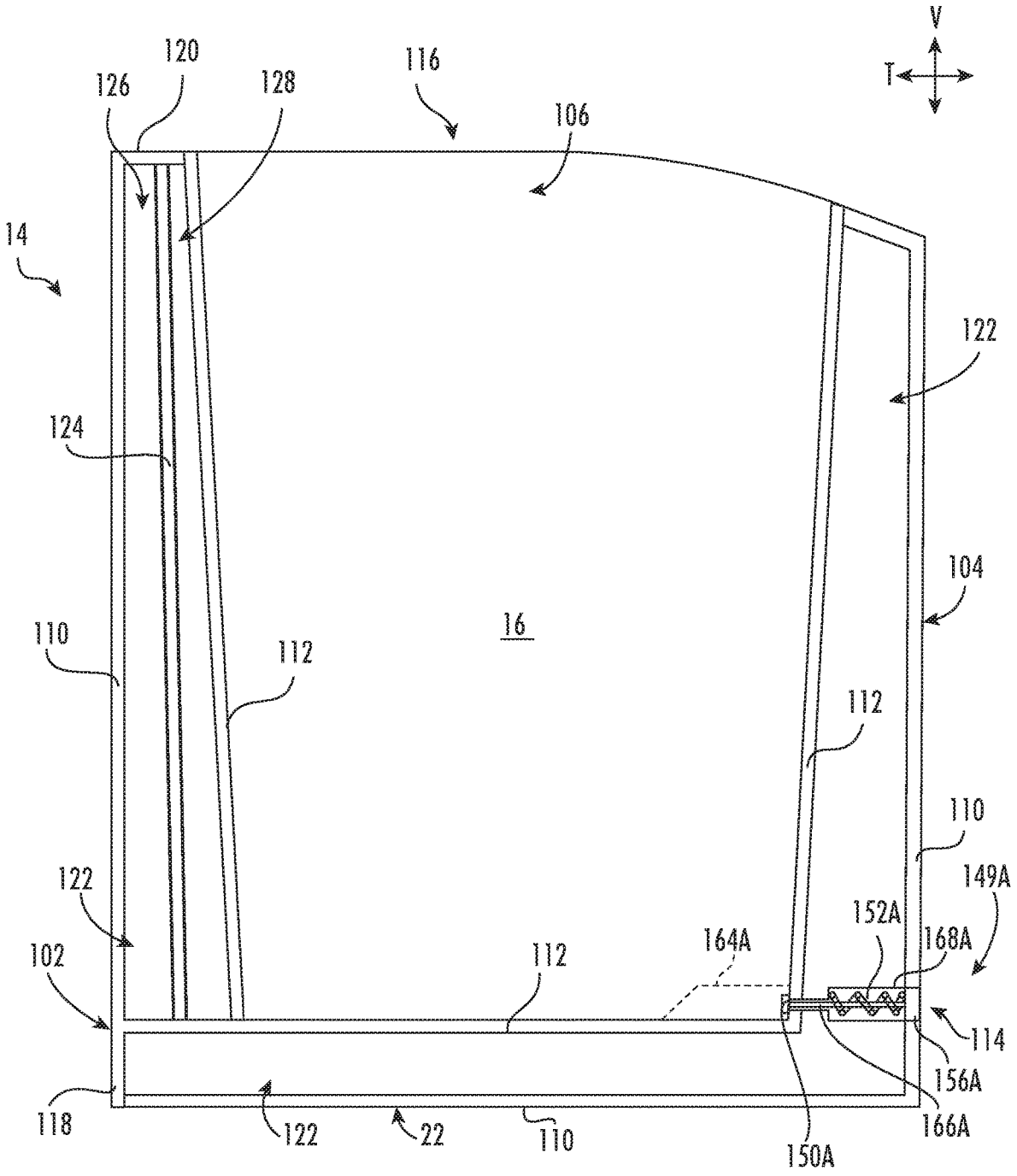
FIG. 4 provides a cross-sectional plan view of an exemplary container of an appliance, such as the exemplary appliance embodiment of FIG. 2.

Referring now to FIGS. 1 through 3, one embodiment of an appliance 10 in accordance with the present disclosure is illustrated. As shown, appliance 10 is provided as a stand-alone ice making appliance embodiment. Appliance 10 includes an outer casing 12 which defines a primary opening 11 (e.g., first primary opening) and an internal cavity or volume 13. Internal volume 13 generally at least partially houses various other components of the appliance therein 10. Primary opening 11 defined in outer casing 12 may extend internal volume 13 to an ambient environment. Through primary opening 11, access (e.g., by a user) to the internal volume 13 may be permitted. Outer casing 12 further defines a vertical direction V, a lateral direction L, and a transverse direction T. The vertical direction V, lateral direction L, and transverse direction T are all mutually perpendicular and form an orthogonal direction system.

A container 14 of appliance 10 is also illustrated. Container 14 defines a first storage volume 16 for the receipt and storage of ice 18 therein. A user of the appliance 10 may access ice 18 within the container 14 for consumption or other uses, as described in detail below. Container 14 may include multiple walls, including one or more sidewalls 20 and a base wall 22, which may together define the first storage volume 16. In exemplary embodiments, at least one sidewall 20 may be formed in part from a clear, see-through (i.e., transparent or translucent) material, such as a clear glass or plastic, such that a user can see into the first storage volume 16 and thus view ice 18 therein. For instance, at least one sidewall 20 may include a separate external panel and internal panel formed from a clear, see-through (i.e., transparent or translucent) material, such as a clear glass or plastic. Further, in exemplary embodiments, container 14 may be removable, such as from the outer casing 12, by a user. This facilitates advantageous easy access by the user to ice within the container 14, as discussed below.

Appliances 10 in accordance with the present disclosure are advantageously stand-alone appliances, and thus are not connected to refrigerators or other appliances. Additionally, in exemplary embodiments, such appliances are not connected to plumbing or another water source that is external to the appliance 10, such as a refrigerator water source. Rather, in exemplary embodiments, water is initially supplied to the appliance 10 manually by a user, such as by pouring water into water tank 24 and/or a reservoir. Optionally, in exemplary embodiments, water tank 24 may be removable, such as from the outer casing 12, by a user. This facilitates advantageous easy access by the user to water tank 24 (e.g., in order to easily fill water tank 24), as discussed below.

Notably, appliances 10 as discussed herein include various features which allow the appliances 10 to be affordable and desirable to typical consumers. For example, the stand-alone feature reduces the cost associated with the appliance 10 and allows the consumer to position the appliance 10 at any suitable desired location, with the only requirement in some embodiments being access to an electrical source. In exemplary embodiments, such as those shown in FIGS. 1 through 3, the removable container 14 allows easy access to ice 18 within first storage volume 16 and allows the container 14 to be moved to a different position from the remainder of the appliance 10 for ice usage purposes.

As discussed herein, appliance 10 is configured to make nugget ice, which is becoming increasingly popular with consumers. Ice 18 may be nugget ice. Generally, nugget ice is ice that that is maintained or stored (i.e., in first storage volume 16 of container 14) at a temperature greater than the melting point of water or greater than about thirty-two degrees Fahrenheit. Accordingly, the ambient temperature of the environment surrounding the container 14 may be at a temperature greater than the melting point of water or greater than about thirty-two degrees Fahrenheit. In some embodiments, such temperature may be greater than forty degrees Fahrenheit, greater than fifty degrees Fahrenheit, or greater than sixty degrees Fahrenheit.

Still referring to FIGS. 1 through 3, various components of appliances 10 in accordance with the present disclosure are illustrated. For example, as mentioned, appliance 10 includes a water tank 24. The water tank 24 defines a second storage volume 26 for the receipt and holding of water. Water tank 24 may include multiple walls, including one or more sidewalls 28 and a base wall 30, which may together define the second storage volume 26. In exemplary embodiments, the water tank 24 may be disposed below the container 14 along the vertical direction V defined for the appliance 10, as shown.

As discussed, in exemplary embodiments, water is provided to the water tank 24 for use in forming ice. Accordingly, appliance 10 may further include a pump 32. Pump 32 may be in fluid communication with the second storage volume 26. For example, water may be flowable from the second storage volume 26 through a fluid outlet 31 defined in the water tank 24, such as in a sidewall 28 thereof, and may flow through a conduit to and through pump 32. Pump 32 may, when activated, actively flow water from the second storage volume 26 therethrough and from the pump 32.

Water actively flowed from the pump 32 may be flowed (e.g., through a suitable conduit) to a reservoir 34. For example, reservoir 34 may define a third storage volume 36. In some embodiments, third storage volume 36 is defined by one or more sidewalls 38 and a base wall 40. Third storage volume 36 may, for example, be in fluid communication with the pump 32 and may thus receive water that is actively flowed from the water tank 24, such as through the pump 32. During operation, water may be flowed into the third storage volume 36 through an opening 44 defined in the reservoir 34.

Reservoir 34 and third storage volume 36 thereof may receive and contain water to be provided to an ice maker 50 for the production of ice. Accordingly, third storage volume 36 may be in fluid communication with ice maker 50. For example, water may be flowed, such as through an opening 42 and through suitable conduits, from third storage volume 36 to ice maker 50.

Ice maker 50 generally receives water, such as from reservoir 34, and freezes the water to form ice 18. In exemplary embodiments, ice maker 50 is a nugget ice maker, and in particular is an auger-style ice maker, although other suitable styles of ice makers and/or appliances are within the scope and spirit of the present disclosure. As shown, ice maker 50 may include a casing 52 into which water from third storage volume 36 is flowed. Casing 52 is thus in fluid communication with third storage volume 36. For example, casing 52 may include one or more sidewalls 54 which may define an interior volume 56, and an opening may be defined in a sidewall 54. Water may be flowed from third storage volume 36 through the opening (such as via a suitable conduit) into the interior volume 56.

As illustrated, an auger 60 may be disposed at least partially within the casing 52. During operation, the auger 60 may rotate. Water within the casing 52 may at least partially freeze due to heat exchange, such as with a refrigeration system as discussed herein. The at least partially frozen water may be lifted by the auger 60 from casing 52. Further, in exemplary embodiments, the at least partially frozen water may be directed by auger 60 to and through an extruder 62. The extruder 62 may extrude the at least partially frozen water to form ice, such as nuggets of ice 18.

Formed ice 18 may be provided by the ice maker 50 to container 14, and may be received in the first storage volume 16 thereof. For example, ice 18 formed by auger 60 and/or extruder 62 may be provide to the container 14. In exemplary embodiments, appliance 10 may include a chute 70 for directing ice 18 produced by the ice maker 50 towards the first storage volume 16. For example, as shown, chute 70 is generally positioned above container 14 along the vertical direction V. Thus, ice can slide off of chute 70 and drop into storage volume 16 of container 14. Chute 70 may, as shown, extend between ice maker 50 and container 14, and may include a body 72, which defines a passage 74 therethrough. Ice 18 may be directed from the ice maker 50 (such as from the auger 60 and/or extruder 62) through the passage 74 to the container 14. In some embodiments, for example, a sweep 64, which may be connected to and rotate with the auger, may contact the ice emerging through the extruder 62 from the auger 60 and direct the ice 18 through the passage 74 to the container 14.

As discussed, water within the casing 52 may at least partially freeze due to heat exchange, such as with a refrigeration system. In exemplary embodiments, ice maker 50 may include a sealed refrigeration system 80. The sealed refrigeration system 80 may be in thermal communication with the casing 52 to remove heat from the casing 52 and interior volume 56 thereof, thus facilitating freezing of water therein to form ice. Sealed refrigeration system 80 may, for example, include a compressor 82, a condenser 84, a throttling device 86, and an evaporator 88. Evaporator 88 may, for example, be in thermal communication with the casing 52 in order to remove heat from the interior volume 56 and water therein during operation of sealed system 80. For example, evaporator 88 may at least partially surround the casing 52. In particular, evaporator 88 may be a conduit coiled around and in contact with casing 52, such as the sidewall(s) 54 thereof.

It should additionally be noted that, in exemplary embodiments, a controller 200 may be in operative communication with the sealed system 80, such as with the compressor 82 thereof, and may activate the sealed system 80 as desired or required for ice making purposes.

In exemplary embodiments, controller 200 is in operative communication with the pump 32. Such operative communication may be via a wired or wireless connection, and may facilitate the transmittal and/or receipt of signals by the controller 200 and pump 32. Controller 200 may be configured to activate the pump 32 to actively flow water. For example, controller 200 may activate the pump 32 to actively flow water therethrough when, for example, reservoir 34 requires water. A suitable sensor(s), for example, may be provided in the third storage volume 36. The sensor(s) may be in operative communication with the controller 200 and may be configured to transmit signals to the controller 200, which indicate whether or not additional water is desired in the reservoir 34. When controller 200 receives a signal that water is desired, controller 200 may send a signal to pump 32 to activate pump 32.

Turning to FIGS. 4 through 8, views of exemplary embodiments of container 14 are provided. It is understood that the indicated directions (i.e., the vertical direction V, lateral direction L, and transverse direction T) of FIGS. 4 through 8 are defined by container 14, but correspond to the same directions defined by casing 12 when container 14 is mounted within appliance 10, as is illustrated in FIG. 2.

Nonetheless, it is also understood that the directions defined by container 14 are otherwise independent of those defined by appliance 10.

As described above, container 14 includes one or more sidewalls and a base wall 22 that define first storage volume 16. In some embodiments, a plurality of sidewalls is provided, including a front wall 102, a rear wall 104, and a pair of oppositely-disposed lateral walls 106. Generally, sidewalls 102, 104, 106 correspond to sidewalls 20 shown in FIG. 2. Front wall 102 may be positioned at a front end while rear wall 104 is positioned at a rear end of container 14. Lateral walls 106 may extend between front wall 102 and rear wall 104 (e.g., along the transverse direction T). Together, the sidewalls 102, 104, 106 define an opening perimeter at a top portion 116 (e.g., vertical extreme) of container 14. As shown, opening perimeter may permit access to first storage volume 16, e.g., to add or remove ice therein. In additional or alternative embodiments, a drain aperture 114 is defined at a bottom portion of container 14. For instance, drain aperture 114 may be defined through one of the walls (e.g., at least one sidewall 102, 104,106 or base wall 22) above water tank 24 (FIG. 2). Ice 18 (FIG. 1) held within the first storage volume 16 may gradually melt. The melting speed is increased for nugget ice due to the increased maintenance/storage temperature. Drain aperture 114, may advantageously drain melt water away from first storage volume 16. Additionally, and advantageously, the melt water may in exemplary embodiments be reused by appliance 10 to form ice.

Exemplary embodiments of container 14 include one or more insulated walls. For instance, one or all of sidewalls (e.g., front wall 102, rear wall 104, and/or lateral walls 106) may be insulated. Optionally, a plurality of insulated sidewalls may be provided at front wall 102, rear wall 104, and/or lateral walls 106. Additionally or alternatively, base wall 22 may be an insulated base wall extending below the sidewalls (e.g., plurality of insulated sidewalls). Advantageously, insulated walls may maintain the temperature of ice within storage volume 16 and/or prevent the formation of condensation on the outer surfaces of container 14.

In some embodiments, an insulated wall (e.g., each insulated wall) includes an internal panel 112 proximal to the storage volume 16 and an external panel 110 distal to the storage volume 16. As shown, internal panel 112 and the external panel 110 define an insulation gap 122 therebetween. For instance, insulation gap 122 may be provided as a sealed volume. The sealed volume may generally prevent the passage of air or oxygen to or from insulation gap 122. In exemplary embodiments, transparent insulation gap 122 is substantially evacuated as a vacuum. In alternative exemplary embodiments, insulation gap 122 is filled with a set mass of a predetermined gas, such as nitrogen, oxygen, argon, or a suitable inert gas. In further alternative exemplary embodiments, insulation gap 122 is filled with a solid insulating material, such as rigid polyurethane insulating foam.

In exemplary embodiments, front wall 102 is provided as an insulated wall. In some such embodiments, when container 14 is inserted into internal volume 13, insulated front wall 102 is positioned across primary opening 11. As shown, insulated front wall 102 includes an external front panel 110 and an internal rear panel 112. Each of front panel 110 and rear panel 112 extend from base wall 22. In some such embodiments, base wall 22 is positioned below a portion of insulated sidewall 102 such that base wall 22 is beneath the rear panel 112 along the vertical direction V. Optionally, each of front panel 110 and rear panel 112) extend vertically from base wall 22 to a top portion 116 of container 14. Front panel 110 and rear panel 112 are spaced apart, e.g., in the transverse direction T at base wall 22. A bottom lip 118 may extend below at least a portion of base wall 22 (e.g., an internal panel 112 of base wall 22) along the vertical direction V from front panel 110. A roof segment 120 may span the distance between front panel 110 and rear panel 112 at the top portion 116 of container 14, e.g., above a transparent insulation gap 122.

In some embodiments, insulation gap 122 is provided as a transparent insulation gap that is defined between front panel 110 and rear panel 112. In optional embodiments, an intermediate panel 124 is disposed within the transparent insulation gap 122. As illustrated in the exemplary embodiment of FIG. 4, intermediate panel 124 may generally extend along the vertical direction V between front panel 110 and rear panel 112. Additionally or alternatively, intermediate panel 124 may extend from base wall 22 to roof segment 120. Optionally, intermediate panel 124 may isolate or seal multiple discrete areas within the transparent insulation gap 122. For instance, a first isolated chamber 126 may be defined within the transparent insulation gap 122 between front panel 110 and intermediate panel 124, while a second isolated chamber 128 is defined between intermediate panel 124 and rear panel 112.

As illustrated in FIGS. 5 through 8, exemplary embodiments of container 14 are selectively moveable between various positions on or within appliance 10. For instance, container 14 may be selectively positionable in a distinct first position (see FIGS. 5 and 7) and a second position (see FIGS. 6 and 8). In the first position of FIGS. 5 and 7, container 14 extends at least partially outside of the internal volume 13 and appliance 10 (FIG. 2). From the first position, container 14 may be removed from appliance 10, e.g., by forward manual linear movement of the container 14 in the transverse direction T away from internal volume 13. From the first position, container 14 may alternatively be inserted further into appliance 10, such as to the second position, e.g., by rearward manual linear movement of the container 14 in the transverse direction T toward internal volume 13. In exemplary embodiments, moving container 14 from the second position to the first position slides container 14 forward in the transverse direction T, e.g., away from internal volume 13. Moving container 14 from the first position to the second position slides container 14 rearward in the transverse direction T, e.g., toward internal volume 13.

Figure 6:
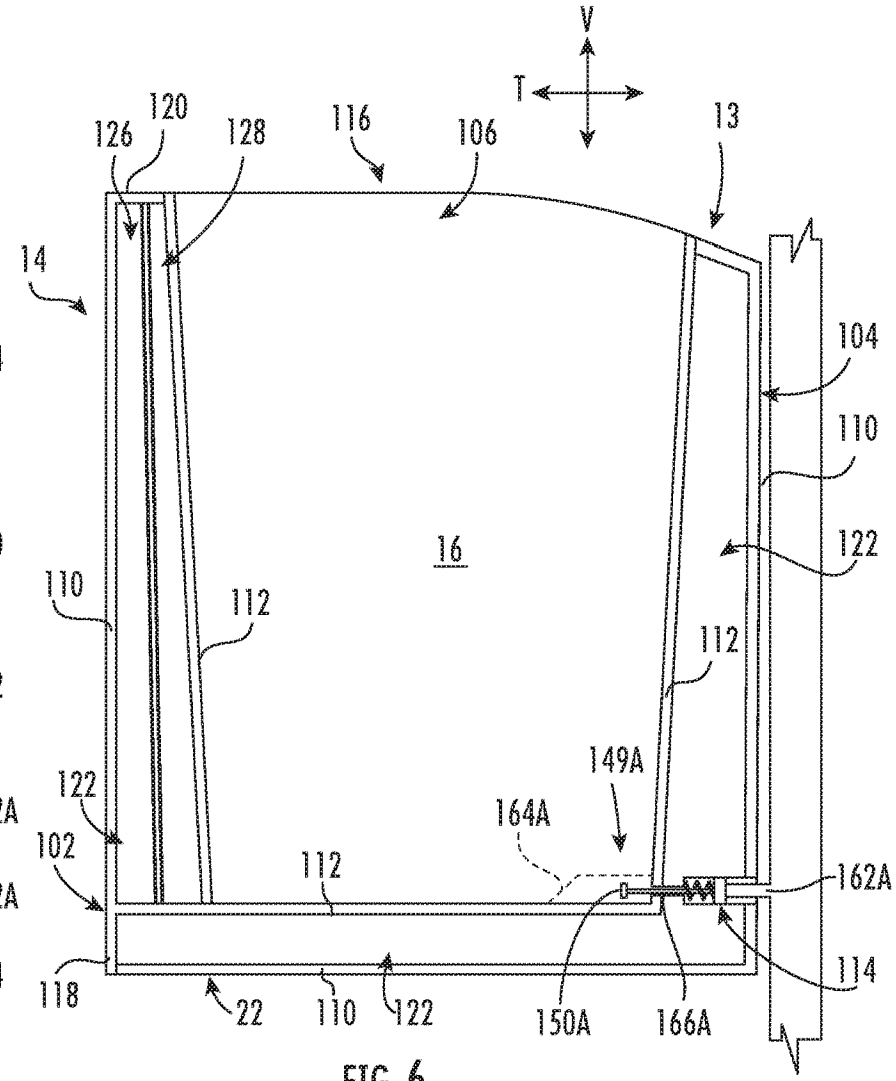
FIG. 6 provides a cross-sectional plan view of the exemplary container of FIG. 4 in a second position.
Figure 8:
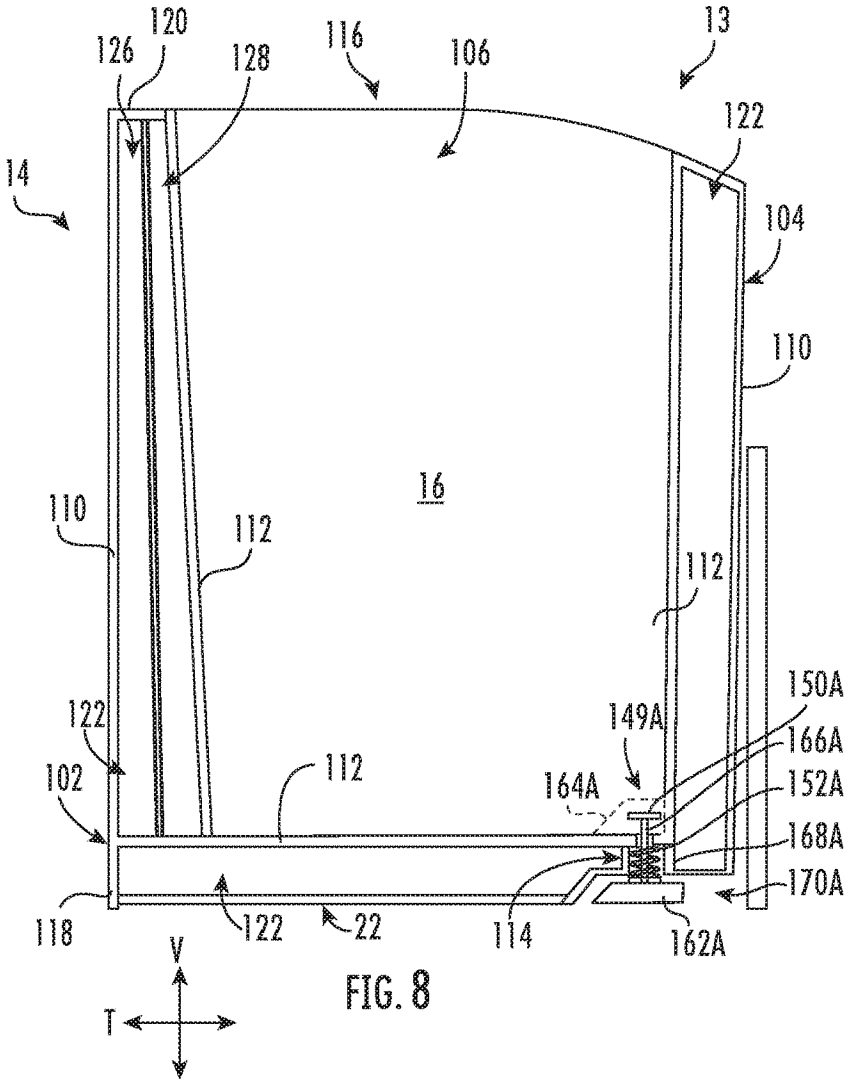
FIG. 8 provides a cross-sectional plan view of the exemplary container of FIG. 7 in a second position.

In the second position of FIGS. 6 and 8, container 14 may be considered fully mounted within internal volume 13. One or more sidewall (e.g., front wall 102, rear wall 104, and/or lateral walls 106) may engage a fixed portion of appliance 10 (e.g., within outer casing 12—FIG. 1) and restrict rearward movement in the transverse direction T. Base wall 22 may extend along a level plane, e.g., a plane that is parallel to transverse direction T and/or lateral direction L.

Figure 5:
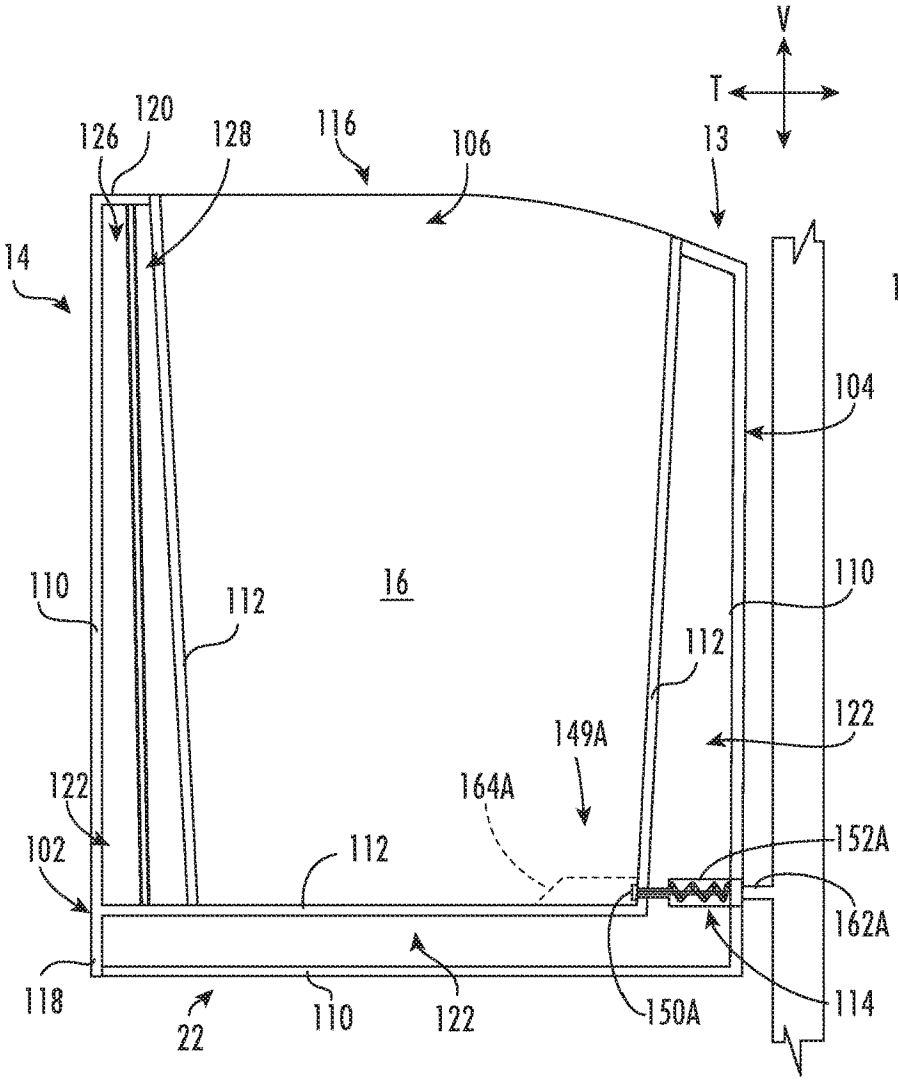
FIG. 5 provides a cross-sectional plan view of the exemplary container of FIG. 4 in a first position.

As shown, some embodiments of container 14 may include a selective sealing system 149A to selectively permit or restrict water from exiting container 14. In exemplary embodiments, a resilient plug 150A is paired to drain aperture 114. In the illustrated embodiments of FIGS. 4 through 6, drain aperture 114 is defined through rear wall 104. Generally, sealing system 149A selectively fills or blocks drain aperture 114 according to a condition of container 14. For instance, in a fully mounted condition, plug 150A may be positioned away from drain aperture 114 within internal volume 13, as illustrated in FIG. 6. Water may be permitted to freely pass through drain aperture 114. In a non-fully mounted condition (e.g., FIG. 5), plug 150A may cover or block drain aperture 114, directly engaging a portion of container 14 (e.g., at internal panel 112), as illustrated in FIG. 5. Thus, plug 150A may have a greater diameter than drain aperture 114 (e.g., at an enlarged head of plug 150A). In a non-mounted condition, water may be substantially prevented or restricted from passing through drain aperture 114.

In certain embodiments, resilient plug 150A includes a rigid guide shaft 166A (e.g., integrally formed with the enlarged head). Optionally, guide shaft 166A may be slidably disposed within drain aperture 114 (e.g., at least partially through insulation gap 122 of rear wall 104) to move between drain aperture 114 and the storage volume 16.

In some embodiments, a spring 152A is attached to plug 150A in biased engagement (e.g., outside of storage volume 16 and/or within the insulation gap 122 of rear wall 104). Spring 152A may generally urge plug 150A toward drain aperture 114. For instance, spring 152A may be embodied as a compression spring 152A coaxially disposed about rigid shaft 166A. Spring 152A may be positioned between a support tab 156A of rigid shaft 166A and internal panel 112. Optionally, aperture walls 168A may extend through insulation gap 122, radially outward from spring 152A between the internal and external panels 112, 110 of rear wall 104. Any water exiting drain aperture 114 may be required to first pass between through insulation gap 122 as guided by aperture walls 168A. Moreover, aperture walls 168A may direct movement of plug 150A and spring 152A, e.g., along the transverse direction T.

A plug prong 162A may be provided in some embodiments of sealing system 149A. As illustrated, plug prong 162A extends through at least a portion of internal volume 13. Plug prong 162A may be fixed to a portion of appliance or casing, e.g., within internal volume 13. When container 14 is in a mounted condition (see FIG. 6), plug prong 162A may be mated with resilient plug 150A (e.g., at support tab 156A) and extend along the transverse direction T through at least a portion of drain aperture 114 and/or insulation gap 122. Plug prong 162A may include a diameter that is less than that of drain aperture 114 such that water is permitted to flow through drain aperture 114. Plug prong 162A may engage plug 150A through drain aperture 114, forcing plug 150A toward storage volume 16 and away from drain aperture 114. When container 14 is positioned away from plug prong 162A, such as in a non-mounted condition (see FIG. 5), plug prong 162A may be disengaged from plug 150A. Spring 152A may force plug 150A toward drain aperture 114, preventing undesired leaks.

In certain embodiments, a perforated plate 164A is positioned over resilient plug 150A. For instance, perforated plate 164A may extend from base wall 22 to rear wall 104, separating resilient plug 150A and drain aperture 114 from storage volume 16. As shown, perforated plate 164A may be positioned between the storage volume 16 and the drain aperture 114. In some such embodiments, perforated plate 164A encloses the portion of resilient plug 150A inside of container 14 (e.g., the portion of resilient plug 150A that is not disposed through drain aperture 114 or within insulation gap 122). Generally, a plurality of perforations through perforated plate 164A permit water (e.g., from melted ice within storage volume 16) to pass through perforated plate 164A. Advantageously, perforated plate 164A may support ice above resilient plug 150A and permit uninterrupted movement thereof (e.g., along the transverse direction T).

Figure 7:
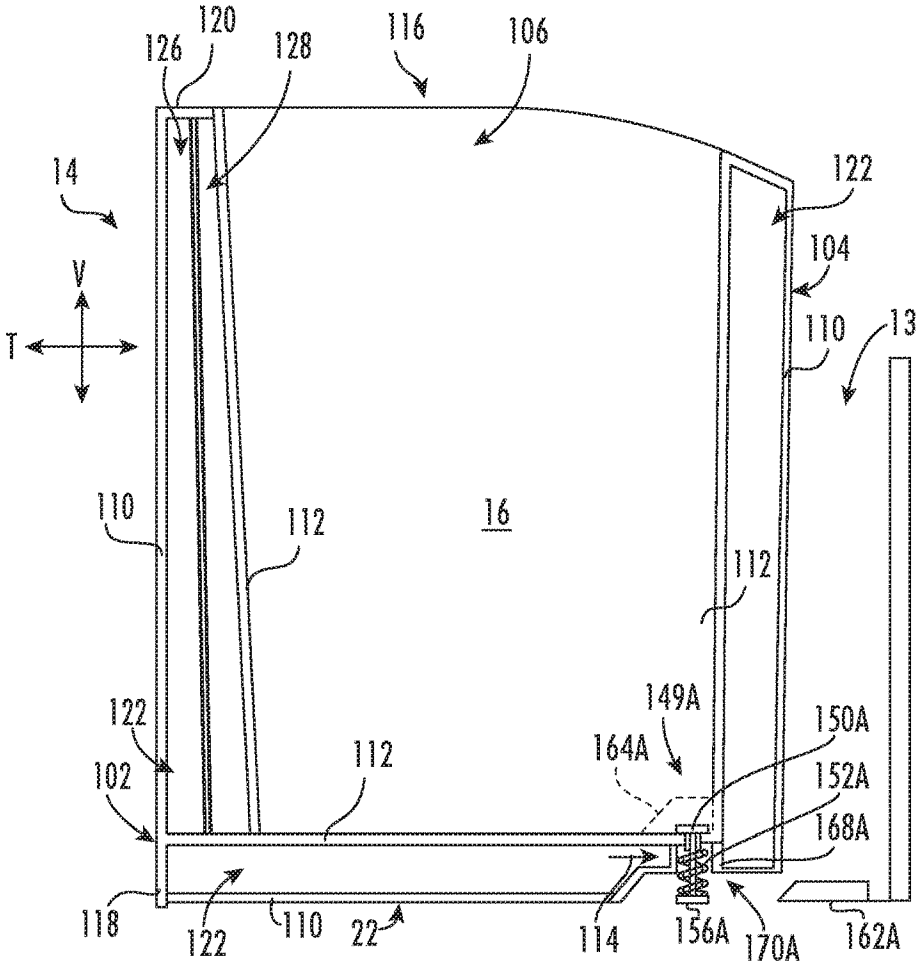
FIG. 7 provides a cross-sectional plan view of another exemplary container of an appliance, such as the exemplary appliance embodiment of FIG. 2, the container being in first position.

Turning to FIGS. 7 and 8, further exemplary embodiments are illustrated having a selective sealing system 149A to selectively permit or restrict water from exiting container 14. In the illustrated embodiments of FIGS. 7 and 8, drain aperture 114 is defined through base wall 22. Generally, sealing system 149A selectively fills or blocks drain aperture 114 according to a condition of container 14. For instance, in a fully mounted condition, plug 150A may be positioned away from drain aperture 114 within internal volume 13, as illustrated in FIG. 8. Water may be permitted to freely pass through drain aperture 114. In a non-fully mounted condition (e.g., FIG. 7), plug 150A may cover or block drain aperture 114, directly engaging a portion of container 14 (e.g., at internal panel 112). Thus, plug 150A may have a greater diameter than drain aperture 114 (e.g., at an enlarged head of plug 150A). In a non-mounted condition, water may be substantially prevented or restricted from passing through drain aperture 114.

In certain embodiments, resilient plug 150A includes a rigid guide shaft 166A (e.g., integrally formed with the enlarged head). Optionally, guide shaft 166A may be slidably disposed within drain aperture 114 (e.g., at least partially through insulation gap 122 of base wall 22) to move between drain aperture 114 and the storage volume 16.

In some embodiments, a spring 152A is attached to plug 150A in biased engagement (e.g., outside of storage volume 16 and/or within the insulation gap 122 of base wall 22). Spring 152A may generally urge plug 150A toward drain aperture 114. For instance, spring 152A may be embodied as a compression spring 152A coaxially disposed about rigid shaft 166A. Spring 152A may be positioned between a support tab 156A of rigid shaft 166A and internal panel 112. Optionally, aperture walls 168A may extend through insulation gap 122, radially outward from spring 152A between the internal and external panels 112, 110 of rear wall 104. Any water exiting drain aperture 114 may be required to first pass between insulation gap 122 as guided by aperture walls 168A. Moreover, aperture walls 168A may direct movement of plug 150A and spring 152A, e.g., along the transverse direction T.

A plug prong 162A may be provided in some embodiments of sealing system 149A as a sloped member. In particular, plug prong 162A may be sloped along the transverse direction T to taper from a relatively narrow forward tip to a relatively wide rear base fixed to a portion of appliance or casing e.g., within internal volume 13. As shown, a receiving channel 170A may be defined along base wall 22 (e.g., along the transverse direction T) to receive plug prong 162A therein. As plug prong 162A is received within receiving channel 170A, plug prong 162A may urge resilient plug 150A upward (e.g., along the vertical direction V). When container 14 is in a mounted condition (see FIG. 8), plug prong 162A may be mated with resilient plug 150A (e.g., at support tab 156A) and extend along the transverse direction T below drain aperture 114 and through at least a portion of receiving channel 170A and/or insulation gap 122. Plug prong 162A may engage plug 150A within receiving channel 170A, forcing plug 150A toward storage volume 16 and away from drain aperture 114. When container 14 is positioned away from plug prong 162A, such as in a non-mounted condition (see FIG. 7), plug prong 162A may be disengaged from plug 150A. Spring 152A may force plug 150A toward drain aperture 114, preventing undesired leaks.

In certain embodiments, a perforated plate 164A is positioned over resilient plug 150A. For instance, perforated plate 164A may extend from base wall 22 to rear wall 104, separating resilient plug 150A and drain aperture 114 from storage volume 16. As shown, perforated plate 164A may be positioned between the storage volume 16 and the drain aperture 114. In some such embodiments, perforated plate 164A encloses the portion of resilient plug 150A inside of container 14 (e.g., the portion of resilient plug 150A that is not disposed through drain aperture 114 or within insulation gap 122). Generally, a plurality of perforations through perforated plate 164A permit water (e.g., from melted ice within storage volume 16) to pass through perforated plate 164A. Advantageously, perforated plate 164A may support ice above resilient plug 150A and permit uninterrupted movement thereof (e.g., along the vertical direction V).

Figure 9:
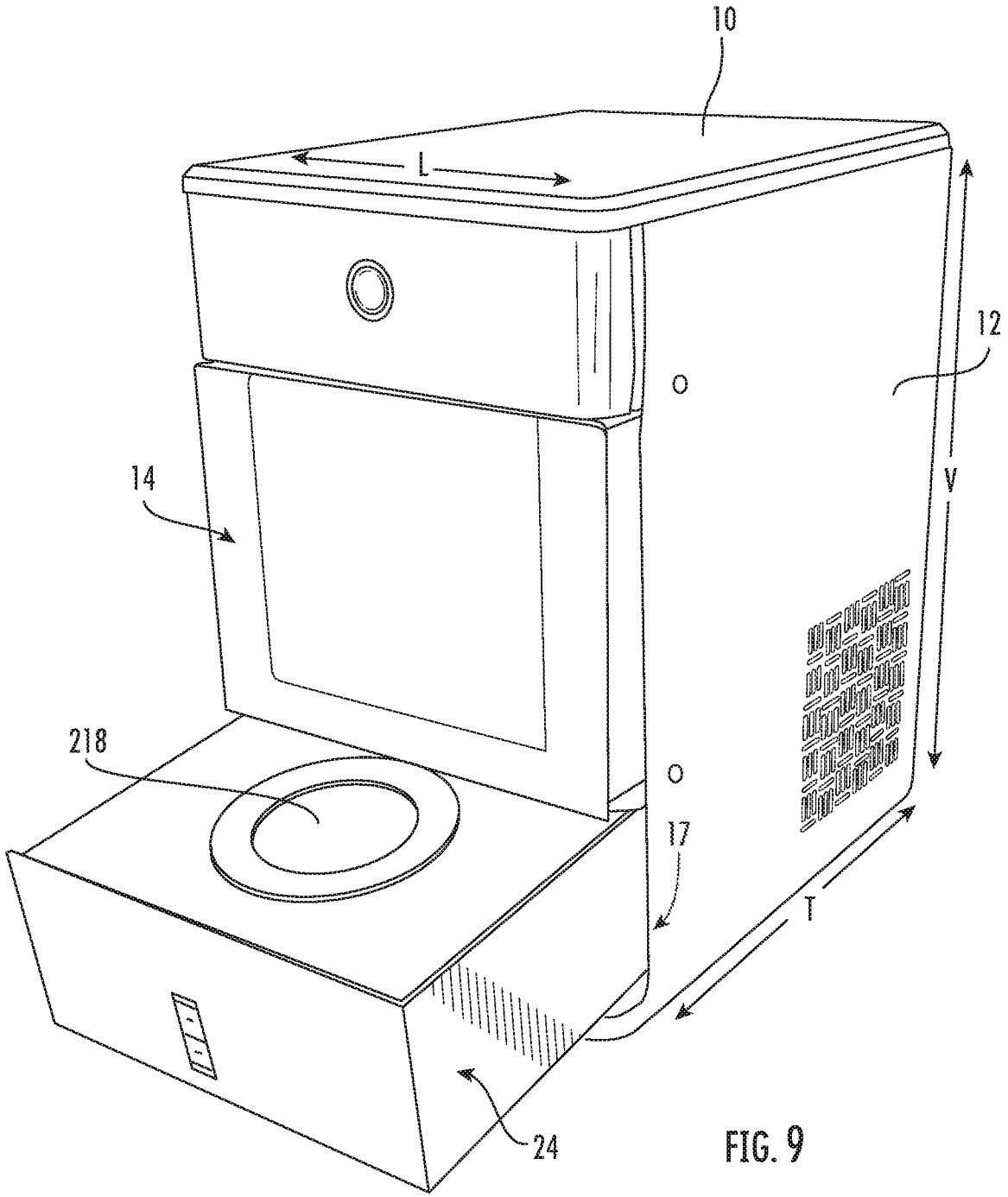
FIG. 9 provides a perspective view of an appliance according to an exemplary embodiment of the present disclosure with a water tank extended therefrom.
Figure 10:
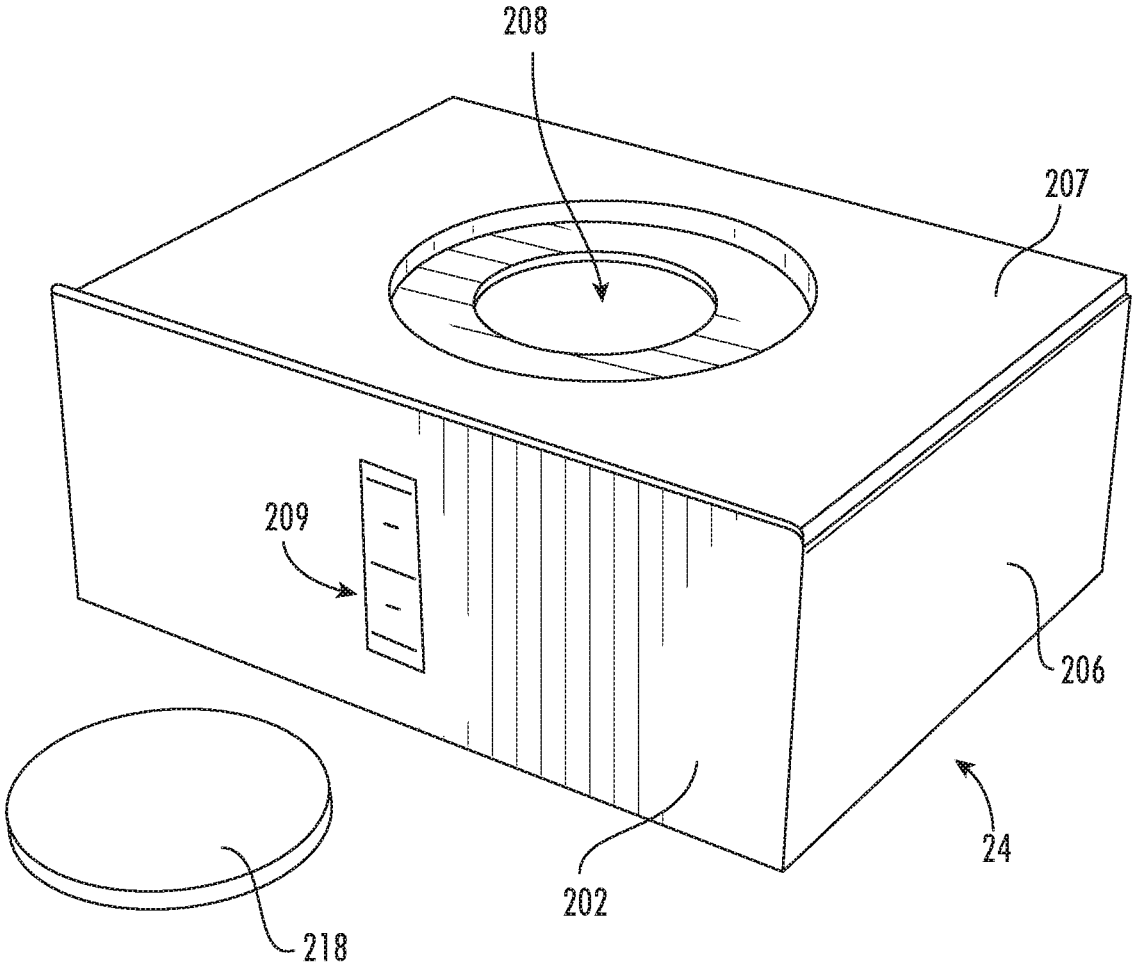
FIG. 10 provides a perspective view of an exemplary water tank of an appliance, such as the exemplary appliance embodiment of FIG. 9.
Figure 11:
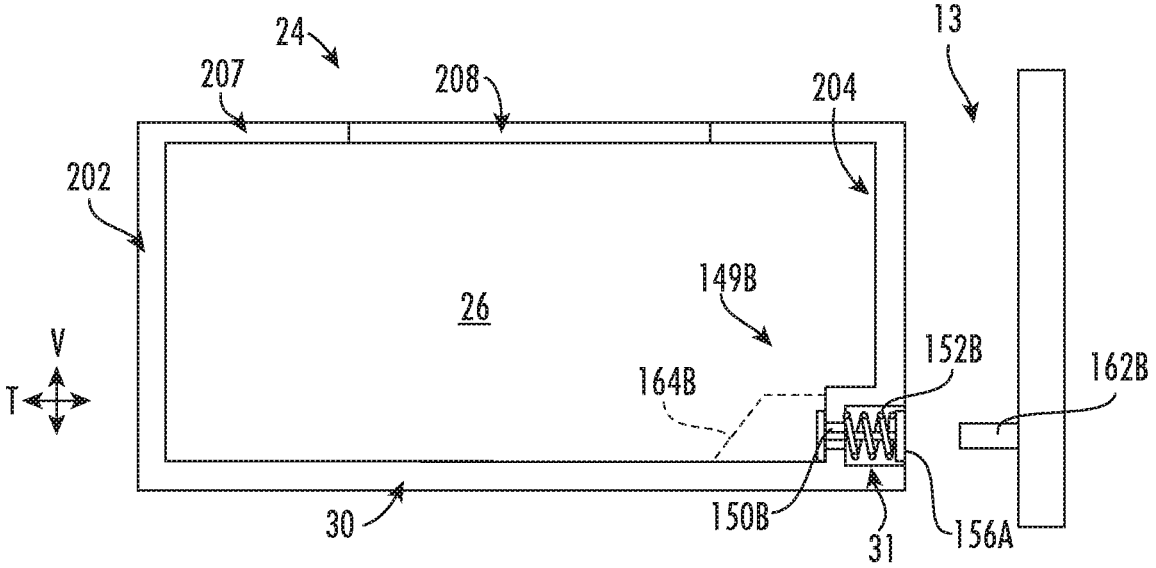
FIG. 11 provides a cross-sectional plan view of an exemplary water tank of an appliance, such as the exemplary appliance embodiment of FIG. 9, the water tank being in first position.

Turning now to FIGS. 9 and 10, in some embodiments, water tank 24 is selectively removable from internal volume 13. For instance, water tank 24 may slide along the transverse direction T below container 14 into and out of internal volume 13 (e.g., through a second primary opening 17). As described above, water tank 24 includes one or more sidewalls and a base wall 30. A top wall 207 may be further included. Together, the sidewalls, base wall 30, and/or top wall 207 define second storage volume 26. In some embodiments, a plurality of sidewalls is provided, including a front wall 202, a rear wall 204, and a pair of oppositely-disposed lateral walls 206, all extending along the vertical direction V between top wall 207 and base wall 30. Generally, sidewalls 202, 204, 206 correspond to sidewalls 28 shown in FIG. 2. Front wall 202 may be positioned at a front end while rear wall 204 is positioned at a rear end of water tank 24. Lateral walls 206 may extend between front wall 202 and rear wall 204 (e.g., along the transverse direction T).

In some embodiments, top wall 207 defines a water opening 208 above the second storage volume 26. A removable lid 218 may be selectively disposed over or through water opening 208 (e.g., to restrict access thereto). As shown in FIG. 10, when water opening 208 is uncovered by lid 218, water opening 208 may permit access to second storage volume 26, e.g., to add or remove water therein. Optionally, a transparent or translucent view window 209 may be provided on front wall 202 (e.g., to provide a visual indication as to the level of water within water tank 24). Additionally or alternatively, one or more walls 30, 202, 204, 206, 207 of water tank 24 may be insulated, similar to the insulation walls of container 14 described above.

Turning now to FIGS. 11 through 14, as noted above, in certain embodiments, a fluid outlet 31 is defined at a bottom portion of water tank 24. For instance, fluid outlet 31 may be defined through one of the walls (e.g., at least one sidewall 202, 204, 206 or base wall 30) below water opening 208. Water held within the second storage volume 26 may be supplied to pump 32 (FIG. 2) through fluid outlet 31.

As illustrated, exemplary embodiments of water tank 24 are selectively moveable between various positions on or within appliance 10. For instance, water tank 24 may be selectively positionable in a distinct first position (see FIGS. 11 and 13) and a second position (see FIGS. 12 and 14). In the first position of FIGS. 11 and 13, water tank 24 extends at least partially outside of the internal volume 13 and appliance 10 (FIG. 9). From the first position, water tank 24 may be removed from appliance 10, e.g., by forward manual linear movement of the water tank 24 in the transverse direction T away from internal volume 13. From the first position, water tank 24 may alternatively be inserted further into appliance 10, such as to the second position, e.g., by rearward manual linear movement of the water tank 24 in the transverse direction T toward internal volume 13. In exemplary embodiments, moving water tank 24 from the second position to the first position slides water tank 24 forward in the transverse direction T, e.g., away from internal volume 13. Moving water tank 24 from the first position to the second position slides water tank 24 rearward in the transverse direction T, e.g., toward internal volume 13.

Figure 12:
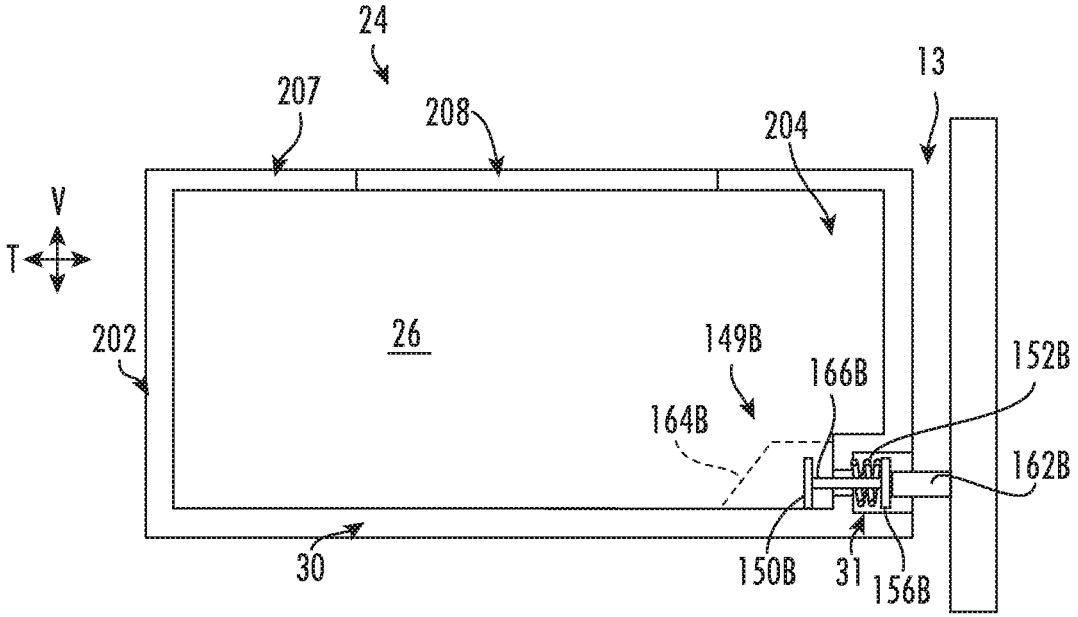
FIG. 12 provides a cross-sectional plan view of the exemplary water tank of FIG. 11 in a second position.
Figure 14:
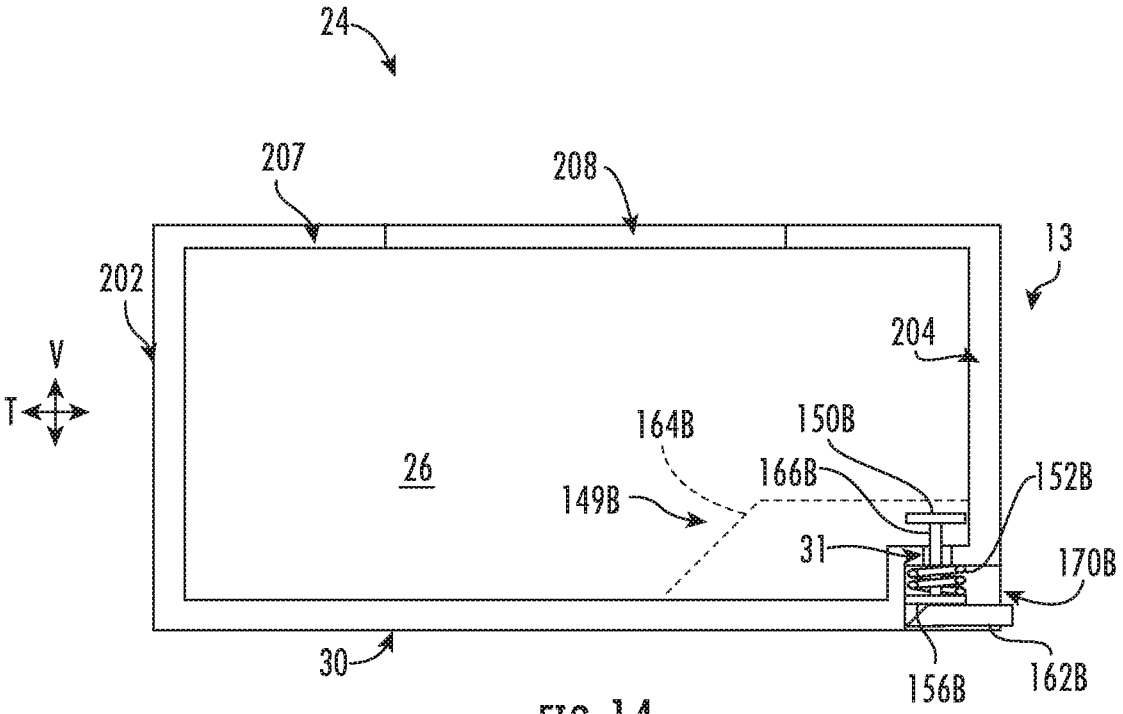
FIG. 14 provides a cross-sectional plan view of the exemplary water tank of FIG. 13 in a second position.

In the second position of FIGS. 12 and 14, water tank 24 may be considered fully mounted within internal volume 13. One or more sidewall (e.g., front wall 202, rear wall 204, or lateral walls 206) may engage a restrict rearward movement in the transverse direction T. Base wall 30 may extend along a level plane, e.g., a plane that is parallel to transverse direction T and/or lateral direction L.

As shown, some embodiments of water tank 24 include a selective sealing system 149B to selectively permit or restrict water from exiting water tank 24. In exemplary embodiments, a resilient plug 150B is paired to fluid outlet 31. In the illustrated embodiments of FIGS. 11 and 12, fluid outlet 31 is defined through rear wall 204. Generally, sealing system 149B selectively fills or blocks fluid outlet 31 according to a condition of water tank 24. For instance, in a fully mounted condition, plug 150B may be positioned away from fluid outlet 31 within internal volume 13, as illustrated in FIG. 12. Water may be permitted to freely pass through fluid outlet 31. In a non-fully mounted condition (e.g., FIG. 11), plug 150B may cover or block fluid outlet 31, directly engaging a portion of water tank 24 (e.g., at an internal panel or surface). Thus, plug 150B may have a greater diameter than fluid outlet 31 (e.g., at an enlarged head of plug 150B). In a non-mounted condition, water may be substantially prevented or restricted from passing through fluid outlet 31. Advantageously, water may be added to water tank 24 while water tank 24 is removed from the casing 12 (FIG. 9), and water tank 24 may be returned/mounted to casing 12 without spilling or leaking water.

In certain embodiments, resilient plug 150B includes a rigid guide shaft 166B (e.g., integrally formed with the enlarged head). Optionally, guide shaft 166B may be slidably disposed within fluid outlet 31 (e.g., at least partially through rear wall 204) to move along the transverse direction T between the fluid outlet 31 of rear wall 204 and the storage volume 26.

In some embodiments, a spring 152B is attached to plug 150B in biased engagement (e.g., within rear wall 204). Spring 152B may generally urge plug 150B toward fluid outlet 31. For instance, spring 152B may be embodied as a compression spring 152B coaxially disposed about rigid shaft 166B. Spring 152B may be positioned between a support tab 156B of rigid shaft 166B and an internal panel or surface of rear wall 204. Any water exiting fluid outlet 31 may be required to first pass through rear wall 204.

A plug prong 162B may be provided in some embodiments of sealing system 149B. As illustrated, plug prong 162B extends through at least a portion of internal volume 13. Plug prong 162B may be fixed to a portion of appliance or casing, e.g., within internal volume 13. When water tank 24 is in a mounted condition (see FIG. 12), plug prong 162B may be mated with resilient plug 150B (e.g., at support tab 156B) and extend along the transverse direction T through at least a portion of fluid outlet 31. Plug prong 162B may include a diameter that is less than that of fluid outlet 31 such that water is permitted to flow through fluid outlet 31. Plug prong 162B may engage plug 150B through fluid outlet 31, forcing plug 150B toward storage volume 26 and away from fluid outlet 31. When water tank 24 is positioned away from plug prong 162B, such as in a non-mounted condition (see FIG. 11), plug prong 162B may be disengaged from plug 150B. Spring 152B may force plug 150B toward fluid outlet 31, preventing undesired leaks.

In certain embodiments, a perforated plate 164B is positioned over resilient plug 150B. For instance, perforated plate 164B may extend from base wall 30 to rear wall 204, separating resilient plug 150B and fluid outlet 31 from storage volume 26. As shown, perforated plate 164B may be positioned between the storage volume 26 and the fluid outlet 31. In some such embodiments, perforated plate 164B encloses the portion of resilient plug 150B inside of water tank 24 (e.g., the portion of resilient plug 150B that is not disposed through fluid outlet 31). Generally, a plurality of perforations through perforated plate 164B permit water to pass through perforated plate 164B. Advantageously, perforated plate 164B may prevent damage to resilient plug 150B and permit uninterrupted movement thereof (e.g., along the transverse direction T).

Figure 13:
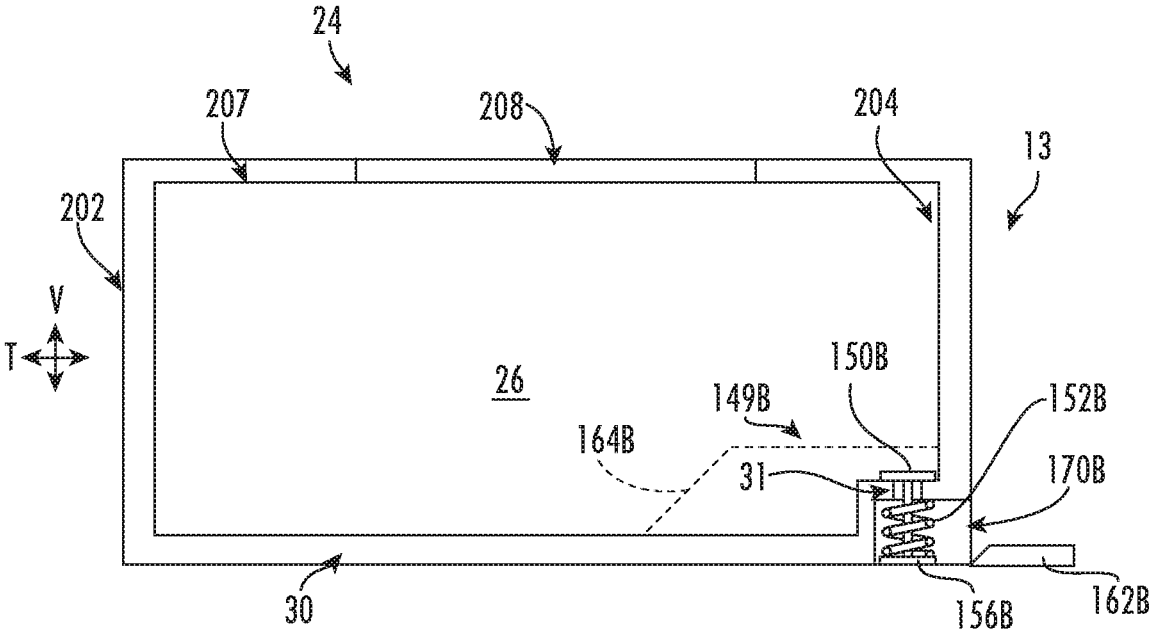
FIG. 13 provides a cross-sectional plan view of another exemplary water tank of an appliance, such as the exemplary appliance embodiment of FIG. 9, the water tank being in first position.

Turning to FIGS. 13 and 14, further exemplary embodiments are illustrated with selective sealing system 149B to selectively permit or restrict water from exiting water tank 24. In the illustrated embodiments of FIGS. 13 and 14, fluid outlet 31 is defined through base wall 30. Generally, sealing system 149B selectively fills or blocks fluid outlet 31 according to a condition of water tank 24. For instance, in a fully mounted condition, plug 150B may be positioned away from fluid outlet 31 within internal volume 13, as illustrated in FIG. 14. Water may be permitted to freely pass through fluid outlet 31. In a non-fully mounted condition (e.g., FIG. 13), plug 150B may cover or block fluid outlet 31, directly engaging a portion of water tank 24 (e.g., at an internal panel or surface thereof). Thus, plug 150B may have a greater diameter than fluid outlet 31 (e.g., at an enlarged head of plug 150B). In a non-mounted condition, water may be substantially prevented or restricted from passing through fluid outlet 31. Advantageously, water may be added to water tank 24 while water tank 24 is removed from the casing 12 (FIG. 9), and water tank 24 may be returned/mounted to casing 12 without spilling or leaking water.

In certain embodiments, resilient plug 150B includes a rigid guide shaft 166B (e.g., integrally formed with the enlarged head). Optionally, guide shaft 166B may be slidably disposed within fluid outlet 31 (e.g., at least partially through base wall 30) to move along the vertical direction V between the fluid outlet 31 of base wall 31 and the storage volume 26.

In some embodiments, a spring 152B is attached to plug 150B in biased engagement (e.g., within base wall 30). Spring 152B may generally urge plug 150B toward fluid outlet 31. For instance, spring 152B may be embodied as a compression spring 152B coaxially disposed about rigid shaft 166B. Spring 152B may be positioned between a support tab 156B of rigid shaft 166B and an internal panel or surface of base wall 30. Any water exiting fluid outlet 31 may be required to first pass through base wall 30.

A plug prong 162B may be provided in some embodiments of sealing system 149B as a sloped member. In particular, plug prong 162B may be sloped along the transverse direction T to taper from a relatively narrow forward tip to a relatively wide rear base fixed to a portion of appliance or casing e.g., within internal volume 13. As shown, a receiving channel 170B may be defined along base wall 30 (e.g., along the transverse direction T) to receive plug prong 162B therein. As plug prong 162B is received within receiving channel 170B, plug prong 162B may urge resilient plug 150B upward (e.g., along the vertical direction V). When water tank 24 is in a mounted condition (see FIG. 14), plug prong 162B may be mated with resilient plug 150B (e.g., at support tab 156B) and extend along the transverse direction T below fluid outlet 31 and through at least a portion of receiving channel 170B. Plug prong 162B may engage plug 150B within receiving channel 170B, forcing plug 150B toward storage volume 26 and away from fluid outlet 31. When water tank 24 is positioned away from plug prong 162B, such as in a non-mounted condition (see FIG. 13), plug prong 162B may be disengaged from plug 150B. Spring 152B may force plug 150B toward fluid outlet 31, preventing undesired leaks.

In certain embodiments, a perforated plate 164B is positioned over resilient plug 150B. For instance, perforated plate 164B may extend from base wall 30 to rear wall 204, separating resilient plug 150B and fluid outlet 31 from storage volume 26. As shown, perforated plate 164B may be positioned between the storage volume 26 and the fluid outlet 31. In some such embodiments, perforated plate 164B encloses the portion of resilient plug 150B inside of water tank 24 (e.g., the portion of resilient plug 150B that is not disposed through fluid outlet 31). Generally, a plurality of perforations through perforated plate 164B permit water to pass through perforated plate 164B. Advantageously, perforated plate 164B may prevent damage to resilient plug 150B and permit uninterrupted movement thereof (e.g., along the vertical direction V).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A stand-alone ice making appliance defining a plurality of mutually-orthogonal directions, the mutually-orthogonal directions including a lateral direction, a transverse direction, and a vertical direction, the stand-alone ice making appliance comprising:

an outer casing defining an internal cavity, the internal cavity including a primary opening through which the internal cavity may be accessed;

a water tank, the water tank defining a storage volume to receive water;

a pump in fluid communication with the storage volume of the water tank to actively flow water therefrom;

an ice maker, the ice maker in fluid communication with the storage volume of the water tank to receive water therefrom; and a container disposed within the internal cavity, the container including a plurality of insulated sidewalls received within the internal cavity, the plurality of insulated sidewalls at least partially defining a storage volume to receive ice from the ice maker, each sidewall of the plurality of sidewalls comprising an internal panel proximal to the storage volume and an external panel distal to the storage volume, the internal panel and the external panel defining an insulation gap therebetween, wherein one insulated sidewall of the plurality of insulated sidewalls is positioned across the primary opening to close the internal cavity, and wherein the insulation gap of at least one sidewall of the plurality of insulated sidewalls encloses a solid insulation material.

2. The stand-alone appliance of claim 1, wherein the container further comprises an insulated base wall extending below the plurality of insulated sidewalls and further defining the storage volume.

3. The stand-alone appliance of claim 1, wherein the insulation gap of at least one sidewall of the plurality of insulated sidewalls includes a sealed volume.

4. The stand-alone appliance of claim 1, wherein the container further comprises a base wall positioned below a portion of the plurality of insulated sidewalls to further define the storage volume of the container, and wherein at least one sidewall of the plurality of insulated sidewalls further includes an intermediate panel extending along the vertical direction from the base wall within the insulation gap between the internal panel and the external panel.

5. The stand-alone appliance of claim 4, wherein the intermediate panel defines a first isolated chamber within the insulated gap between the internal panel and the intermediate panel, and a second isolated chamber within the insulation gap between the intermediate panel and the external panel.

6. The stand-alone appliance of claim 1, wherein the container further defines a drain aperture above the water tank along the vertical direction and in fluid communication between the storage volume of the container and the storage volume of the water tank.

7. A stand-alone ice making appliance defining a plurality of mutually-orthogonal directions, the mutually-orthogonal directions including a lateral direction, a transverse direction, and a vertical direction, the stand-alone ice making appliance comprising:

an outer casing defining an internal cavity, the internal cavity including a primary opening through which the internal cavity may be accessed;

a water tank, the water tank defining a storage volume to receive water;

a pump in fluid communication with the storage volume of the water tank to actively flow water therefrom;

an ice maker, the ice maker in fluid communication with the storage volume of the water tank to receive water therefrom;

a container selectively positioned within the internal cavity, the container comprising a plurality of walls defining a storage volume to receive ice from the ice maker, a drain aperture defined through one wall of the plurality of walls, the drain aperture being in fluid communication between the storage volume of the container and the storage volume of the water tank, and a biased sealing plug paired with drain aperture, the biased sealing plug being urged toward the drain aperture to selectively restrict fluid communication therethrough;

a perforated plate positioned over the biased sealing plug between the storage volume of the container and the drain aperture; and a plug prong fixed within the outer casing and selectively mated with the biased sealing plug to urge the biased sealing plug away from the drain aperture, wherein plurality of walls of the container comprises an insulated front wall positioned across the primary opening to close the internal cavity.

8. The stand-alone appliance of claim 7, wherein plurality of walls of the container comprises at least one sidewall and a base wall from which the at least one sidewall extends, wherein the drain aperture is defined through the at least one sidewall.

9. The stand-alone appliance of claim 7, wherein plurality of walls of the container comprises at least one sidewall and a base wall from which the at least one sidewall extends, wherein the drain aperture is defined through the base wall.

10. The stand-alone appliance of claim 7, wherein plurality of walls of the container comprises an insulated wall spaced apart from the insulated front wall, and wherein the drain aperture is defined through the insulated wall.

11. The stand-alone appliance of claim 7, wherein plurality of walls of the container comprises a rear wall and a base wall from which the rear wall extends, wherein the perforated plate extends from the rear wall to the base wall.

12. The stand-alone appliance of claim 7, wherein the biased sealing plug is slidably disposed within the drain aperture.

13. A stand-alone ice making appliance defining a plurality of mutually-orthogonal directions, the mutually-orthogonal directions including a lateral direction, a transverse direction, and a vertical direction, the stand-alone ice making appliance comprising:

an outer casing defining an internal cavity, the internal cavity including a first primary opening and a second primary opening through which the internal cavity may be accessed;

a pump disposed within the outer casing to actively flow water therethrough;

a water tank selectively positioned within the internal cavity through the second primary opening in fluid communication with the pump, the water tank comprising a plurality of walls defining a storage volume to receive water upstream from the pump, one wall of the plurality of walls being positioned across the second primary opening to restrict access to the internal cavity, a fluid outlet defined through one wall of the plurality of walls, the fluid outlet being in fluid communication between the storage volume of the water tank and the pump, and a biased sealing plug paired with the fluid outlet, the biased sealing plug being urged toward the fluid outlet to selectively restrict fluid communication therethrough;

a plug prong fixed within the outer casing and selectively mated with the biased sealing plug to urge the biased sealing plug away from the fluid outlet;

an ice maker, the ice maker in fluid communication with the storage volume of the water tank to receive water therefrom; and a container selectively positioned within the internal cavity through the first primary opening, the container defining a storage volume to receive ice from the ice maker, wherein the plurality of walls of the water tank comprises at least one sidewall and a base wall from which the at least one sidewall extends, and wherein the fluid outlet is defined through the base wall.

14. The stand-alone appliance of claim 13, further comprising a perforated plate positioned over the biased sealing plug between the storage volume of the water tank and the fluid outlet.

15. The stand-alone appliance of claim 14, wherein plurality of walls of the water tank comprises a rear wall and a base wall from which the rear wall extends, wherein the perforated plate extends from the rear wall to the base wall.

16. The stand-alone appliance of claim 13, wherein the biased sealing plug is slidably disposed within the fluid outlet.

17. A stand-alone ice making appliance defining a plurality of mutually-orthogonal directions, the mutually-orthogonal directions including a lateral direction, a transverse direction, and a vertical direction, the stand-alone ice making appliance comprising:

an outer casing defining an internal cavity, the internal cavity including a first primary opening and a second primary opening through which the internal cavity may be accessed;

a pump disposed within the outer casing to actively flow water therethrough;

a water tank selectively positioned within the internal cavity through the second primary opening in fluid communication with the pump, the water tank comprising a plurality of walls defining a storage volume to receive water upstream from the pump, one wall of the plurality of walls being positioned across the second primary opening to restrict access to the internal cavity, a fluid outlet defined through one wall of the plurality of walls, the fluid outlet being in fluid communication between the storage volume of the water tank and the pump, a biased sealing plug paired with the fluid outlet, the biased sealing plug being urged toward the fluid outlet to selectively restrict fluid communication therethrough, and a perforated plate positioned over the biased sealing plug between the storage volume of the water tank and the fluid outlet;

a plug prong fixed within the outer casing and selectively mated with the biased sealing plug to urge the biased sealing plug away from the fluid outlet;

an ice maker, the ice maker in fluid communication with the storage volume of the water tank to receive water therefrom; and a container selectively positioned within the internal cavity through the first primary opening, the container defining a storage volume to receive ice from the ice maker.

18. The stand-alone appliance of claim 17, wherein plurality of walls of the water tank comprises at least one sidewall and a base wall from which the at least one sidewall extends, wherein the fluid outlet is defined through the at least one sidewall.

19. The stand-alone appliance of claim 17, wherein plurality of walls of the water tank comprises a rear wall and a base wall from which the rear wall extends, wherein the perforated plate extends from the rear wall to the base wall.

20. The stand-alone appliance of claim 17, wherein the biased sealing plug is slidably disposed within the fluid outlet.

* * * * *